US005683316A

United States Patent [19]

Campbell

[11] Patent Number: 5,683,316

[45] Date of Patent: Nov. 4, 1997

[54] ILLUMINATED SPORTS BALL

[76] Inventor: Daniel Scott Campbell, 20262 Colonial Cir., Huntington Beach, Calif. 92646

[21] Appl. No.: 707,902

[22] Filed: Sep. 12, 1996

[51] Int. Cl.[6] ..... A63B 43/06

[52] U.S. Cl. ..... 473/570; 273/DIG. 24

[58] Field of Search ..... 273/58 R, 58 E, 273/58 F, 58 G, 58 H, 58 A, 65 R, 65 ED, 65 EF, 65 E, 65 EC, 65 EG, DIG. 24, DIG. 20; 473/570, 571, 572, 573, 596, 597, 599, 613

[56] References Cited

U.S. PATENT DOCUMENTS

| | | | |
|---|---|---|---|
| 3,935,669 | 2/1976 | Potrzuski et al. | 473/570 |
| 4,133,528 | 1/1979 | Koblick | 473/570 |
| 4,867,452 | 9/1989 | Finley | 473/569 |
| 4,930,776 | 6/1990 | Newcomb et al. | 273/58 G |
| 4,979,751 | 12/1990 | Sullivan, III | 273/58 G |
| 5,066,012 | 11/1991 | Stark | 473/570 |
| 5,186,458 | 2/1993 | Redondo | 273/58 G |
| 5,232,635 | 8/1993 | Van Moer et al. | 252/700 |
| 5,370,390 | 12/1994 | Swanson | 273/DIG. 24 |
| 5,388,825 | 2/1995 | Myers et al. | 473/570 |
| 5,403,000 | 4/1995 | Woosley | 273/DIG. 24 |
| 5,451,046 | 9/1995 | Batton | 473/570 |

*Primary Examiner*—Steven B. Wong

*Attorney, Agent, or Firm*—Knobbe, Martens, Olson & Bear LLP

[57] ABSTRACT

An illuminated sports ball including flexible transparent tubing on its exterior for housing and exposing flexible light sources. The tubing is recessed in grooves around the ball so that only a portion thereof projects outward from the exterior surface of the ball. In one embodiment, the grooves terminate at common points on the ball and a central throughbore extends through the ball between these common points. An anchor cord which extends through a bore within the ball may be attached to the ends of the tubes to secure the tubes in the grooves. The tubes may extend within the ball to attach to the anchor cord, or to other tubes positioned around the ball. The light sources are chemiluminescent light sticks which are inserted into the tubes through a central slot. The slot desirably faces the grooves during use and the tubes are torsionally flexible and can be rotated to face outward for inserting the light sticks. In one embodiment the grooves extend in direct paths around the exterior periphery of the ball, while in a second embodiment the grooves follow non-linear paths around the ball.

30 Claims, 6 Drawing Sheets

ILLUMINATED SPORTS BALL

RELATED APPLICATION

This application claims the priority benefit under 35 U.S.C. § 119(e) of provisional application Ser. No. 60/007,640 filed Nov. 28, 1995.

1. Field of the Invention

The invention relates to games and amusement devices and, more particularly, to an illuminated sport ball utilizing chemiluminescent light sticks on its exterior.

2. Background of the Invention

There have been many attempts to illuminate playing balls. Many of these illuminated balls rely on battery powered incandescent light bulbs on the interior of the ball which are either focussed to shine directly through selected windows in the exterior of the ball, or which illuminate the interior of the ball, and the diffused light produced inside the ball is visible through transparent sections of the ball surface. In these devices, and in other similar devices, the batteries eventually wear out and, if left too long in the interior of the bail, will corrode. Furthermore, the light emitting elements are prone to breakage and need to be replaced. Perhaps the most significant drawback to these devices is the requirement of a rigid casing for housing the batteries and light emitting elements. This rigid housing detracts from the desirable compressibility of the ball, leading to an unnatural feel and bounce. Furthermore, the various elements within the ball add to the weight of the ball, and may significantly alter the balance thereof.

Battery-powered devices are disclosed in U.S. Pat. Nos. 4,133,528, issued to Koblick, and U.S. Pat. No. 5,186,458, issued to Redondo. In the Koblick patent, an inner rigid casing within a football houses three helical springs, a lamp, and two batteries. A series circuit is completed through the batteries to the springs and back to the lamp. The exterior of the football includes apertures which allow light to pass through from the hollow interior. In the Redondo patent, a centrally located rigid housing encloses a pair of light emitting elements, such as light bulbs or light-emitting diodes. The light emitting elements face outward toward the points of the football. In an alternative embodiment, a cage of resilient transparent material is stretched over the entire ball and apparently is illuminated when the inner light emitting elements are energized. This cage appears to be relatively cumbersome and prone to interfere with the throwing dynamics of the ball.

More recently, various game balls have been developed which utilize chemiluminescent light sources, thus eliminating the problems with batteries and light bulbs. One such device is shown in U.S. Pat. No. 5,403,000 to Woosley. A game ball is shown which includes an inner housing for insertion of a chemiluminescent light stick. The game ball includes regions around its exterior skin of reduced thickness which are translucent or transparent. The light from the interior of the ball generated by the chemiluminescent light stick shines through these reduced thickness areas to the exterior of the ball in a predetermined pattern. Again, however, this ball requires a rigid housing for the light stick, and is imbalanced by the position of the light stick housing in one side of the ball. Furthermore, the intensity of the light transmitted through the reduced thickness of the ball may be insufficient to illuminate the ball in twilight or in night games where there is substantial back lighting.

In U.S. Pat. No. 4,979,571 to Sullivan, III, a lighted football strap or harness is shown which includes flexible tubes having cuts therein for receiving chemiluminescent light sticks. In one embodiment, two tubes are arranged longitudinally along the football and are secured thereto with the use of the straps. In a second embodiment, the two longitudinal tubes are supplemented by two ring-like assemblies of tubes for receiving further light sticks. The drawback to both of these embodiments is the cumbersome nature of the harness when secured to the exterior of the ball. More particularly, the two rings around the cone like portions of the ends of the ball greatly interferes with the ball's aerodynamics. Furthermore, the harness in one embodiment is riveted together, and is thus not adjustable to allow the harness to be secured to the ball. The harness can thus be easily knocked off the ball with rough handling. Further, the rivets, being metallic objects, pose a threat of injury to the player if struck with the ball sufficiently hard. Although the patent to Sullivan, III contemplates the use of adjustment straps for securing the harness to the ball, this does not solve the problem of poor aerodynamics and weight characteristics of the ball, and may leave loose straps hanging off the ball.

SUMMARY OF THE INVENTION

The present invention is a novel illuminated sports ball. The preferred embodiment of the invention includes shallow grooves in which elongated flexible, transparent hollow tubes are recessed. Flexible sources of illumination, such as chemiluminescent light sticks, are housed within the tubes. These flexible chemiluminescent light sticks provide illumination for use of the ball in dim or poor lighting. Thus, in one version, the ball is a foam-type football and there are two tubes having light sticks inserted within extending between the opposite noses of the football.

A significant feature of the present invention is that the recessed configuration of the tubes reduces the impact on aerodynamics and feel of the ball, yet the sources of illumination are exposed on the exterior of the ball. The grooves are preferably at least half the diameter of the tubes, and each tube is secured at either end of its associated groove to help reduce the chance of snagging the tubes on fingers, for example.

In another feature of the preferred embodiment, the illuminated sports ball includes a central bore through the longitudinal centerline of the football. An anchoring cord extends through the central bore. At least one of the flexible, transparent hollow tubes traverses the exterior of the ball and is attached to opposed ends of the cord to securely retain the tube to the ball.

In another advantageous feature, an aperture is formed in each tube for insertion of a light sticks. The aperture is located around the circumference of the ball so that it faces the groove in a relaxed position of the tube. To insert the light stick, the tube is stretched slightly away from the groove, and/or the ball is compressed to separate the groove from the tube, and the tube is rotated to expose the aperture. The light stick is then inserted in the tube through the exposed aperture and the tube and ball are released allowing the tube to resume its recessed position within the groove. In this way, dirt and moisture are prevented from entering the tube through the aperture during use of the ball.

An advantage of the present invention over previous illuminated sports balls is the elimination of the need for rigid battery or light bulb housings. By using flexible sources of light, the aerodynamics and feel of the ball are improved. Furthermore, the sources of light are at least partially recessed below the surface of the ball to reduce discontinuities therearound.

DETAILED DESCRIPTION OF THE PREFERRED EMBODIMENT

Figure 2:
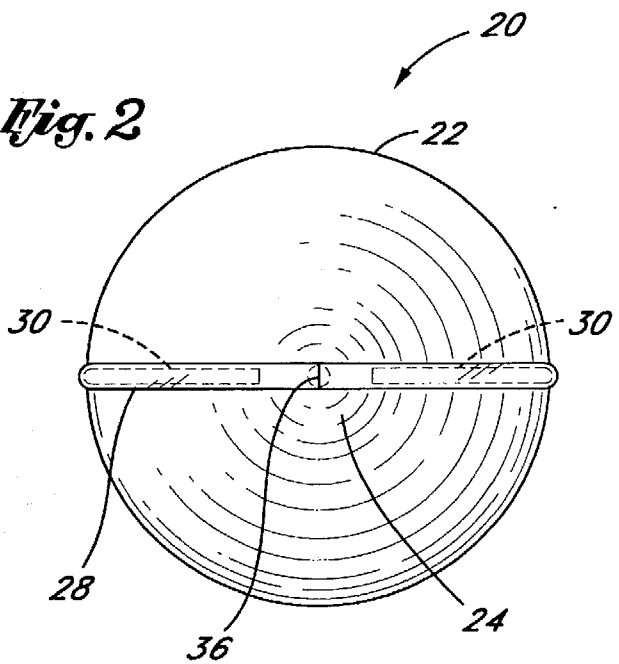
FIG. 2 is an end elevational view of the sports ball shown in FIG. 1.
Figure 1:
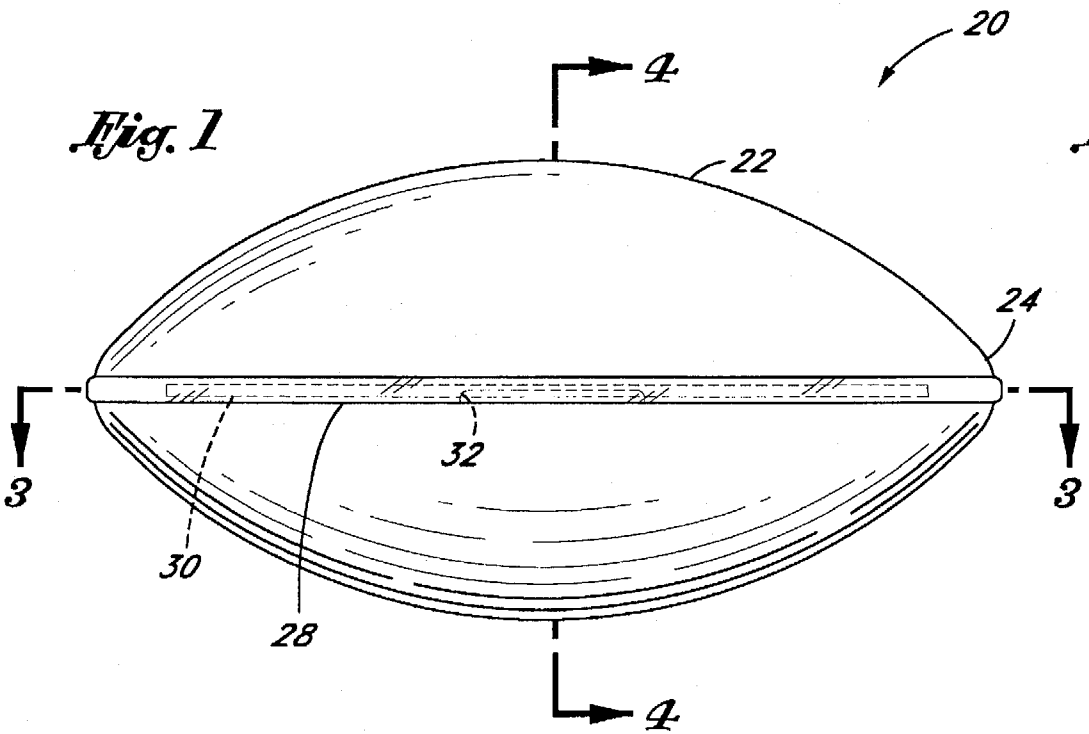
FIG. 1 is a side elevational view of an illuminated sports ball of the present invention.

FIGS. 1 and 2 illustrate an illuminated sports ball in accordance with the present invention which is both highly visible and which has improved aerodynamics and handling capabilities over the prior art. In the illustrated embodiment, the sports ball comprises a football 20 having a generally lenticular body portion 22 terminating at opposite ends in oppositely facing tapered noses 24. Football 20 is preferably made out of soft foam material, although it is possible to incorporate the illumination structure into an inflatable type football with some modifications, as will be appreciated by one of skill in the art. Also, although the present invention is described herein in relation to a football, other sports balls, such as, for example, soccer balls or basketballs, can advantageously incorporate the illumination structure described herein.

Figure 4:
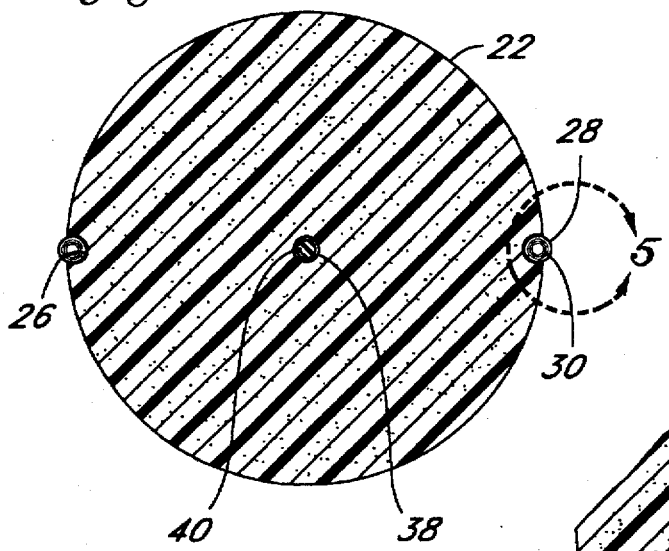
FIG. 4 is a cross-sectional view through the illuminated sports ball taken along line 4—4 of FIG. 1.
Figure 5:
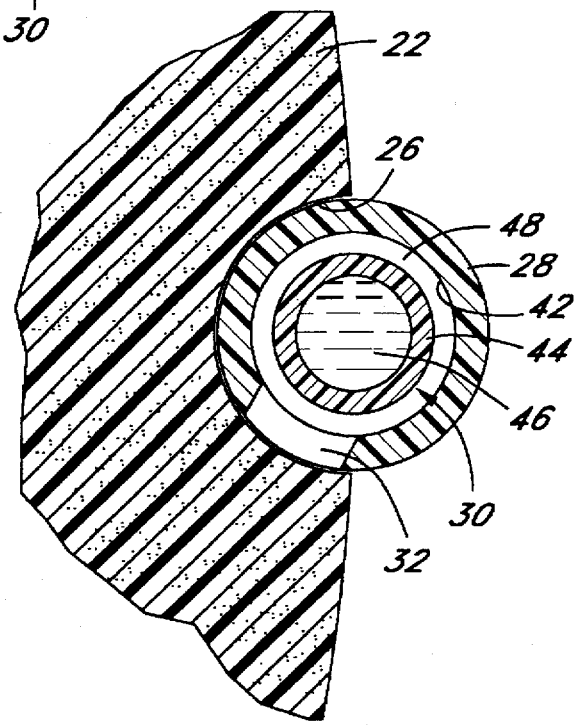
FIG. 5 is an enlarged cross-sectional view of a flexible tube embedded in one side of the illuminated sports ball.

As seen best in FIGS. 4 and 5, the football 20 includes opposed outwardly facing grooves 26 for receiving an elongated flexible tube housing 28. The grooves 26, and thus the housing 28, extend between points at the opposite noses 24 of the football on either side thereof. The flexible housing 28 encapsulates an elongated light source 30 therewithin, and in this respect, the flexible housing 28 is, preferably, transparent or at least partly transparent. A feature of the invention is that it maintains a low profile for the flexible tubing to minimize the impact to the aerodynamics of the football, and thus only two grooves 26 and lengths of flexible housing 28 between the noses 24 are preferred. However, although in the preferred embodiment shown the flexible tubing extends on two sides of the football 20, the tubing may be provided along three or more grooves from the opposed noses 24 of the football, as desired.

The flexible housing 28 includes a longitudinally-oriented slot 32 located centrally between the opposed noses 24. Slot 32 has a length sufficient to allow insertion and removal of the light source 30. Desirably, the distance from one end of the flexible housing 28 to a distal end of the slot 32 is sufficient to facilitate insertion of the light source 30 through the slot without unduly bending or otherwise contorting the flexible light source. That is, one end of the light source 30 inserts through the slot 32 and the light source feeds into the housing 28 as far as possible, wherein the free end of the light source is then inserted into the slot without much bending. In this regard, the light source 30 is preferably a flexible tubular member, such as a chemiluminescent light stick.

Chemiluminescent light sticks are typically constructed of an outer tubular housing having an inner enclosure with one chemical therein surrounded by a second chemical within the tubular housing. Upon snapping or otherwise bending the light stick, the inner enclosure ruptures leading to the mixing of the two chemicals within the housing. The two chemicals are such that a chemiluminescent light is generated for a certain period to time after mixing. One example of chemiluminescent solutions is given in U.S. Pat. No. 5,232,635 assigned to American Cyanamid Co. of Stamford, Conn. Various configurations of the chemiluminescent light sticks are available commercially, as is known by those of skill in the art. One suitable light stick sold under the trademark Magic in the Night by Omniglow Corp. of Portsmouth, England, uses a chemiluminescent liquid sold under the trademark Cyalume by American Cyanamid.

In the embodiment of FIGS. 1–6, the light source 30, comprising the chemiluminescent light stick, advantageously has a length slightly shorter than the length of the flexible housing 28 on one side of the football 20 between the outer noses 24. By way of specific example, a typical foam football has a length of approximately 10 inches, and with the curvature of the lenticular body 22, the flexible housing 28 extending from nose to nose 24 has a length of approximately 11 inches. The light source 30 may have a length of between 5 and 8 inches, with a length of 8 inches being preferred. In this manner, the light source 30 extends substantially from nose to nose 24 of the football 20, but has a sufficient clearance to be slid along the flexible tubing to enable easy insertion through the slot 32. The slot 32 desirably has a length of between 2 and 4 inches.

To install the light source 30, one end thereof is inserted within the slot 32 and the entire light source slid along the flexible housing 28 as far as it can go. The portion of the light source 30 still extending from the slot 32 is then bent and the opposite end inserted into the slot and threaded within the flexible housing 28. The light source 30 can then be centered along the flexible housing 28. This ability to easily and quickly install and remove the light source 30 from the football 20, while normally securely retaining the light source 30 within the flexible housing 28, is not shown in the prior art.

Another significant feature of the invention which has not been adequately addressed in the prior art is the secure configuration in which the flexible housing 28 is fastened to the football 20. More particularly, the grooves 26 themselves help retain the flexible tubing in its longitudinally oriented location around the football 20. The ends of the flexible housing 28 on each side of the football 20 are crimped slightly at a region 34 approximate the nose 24 of the football. The opposite flexible housings 28 meet at a common point, or junction 36 directly at the apex of the nose 24. The junction 36 comprises a bonded portion of the tubes to secure the tubes together. More particularly, the flexible housing 28 is preferably manufactured of a conventional clear plastic tubing subject to melting and welding to itself. The terminal ends at the junction 36 are thus crimped together and heat bonded. This structure in itself would be quite secure, in combination with the embedded nature provided by the groove 26. Because the flexible housing 28 only partially projects outward from the exterior of the football 20, disengagement between the tubing and the football is less likely, which has not been the case with devices of the prior art.

Figure 3:
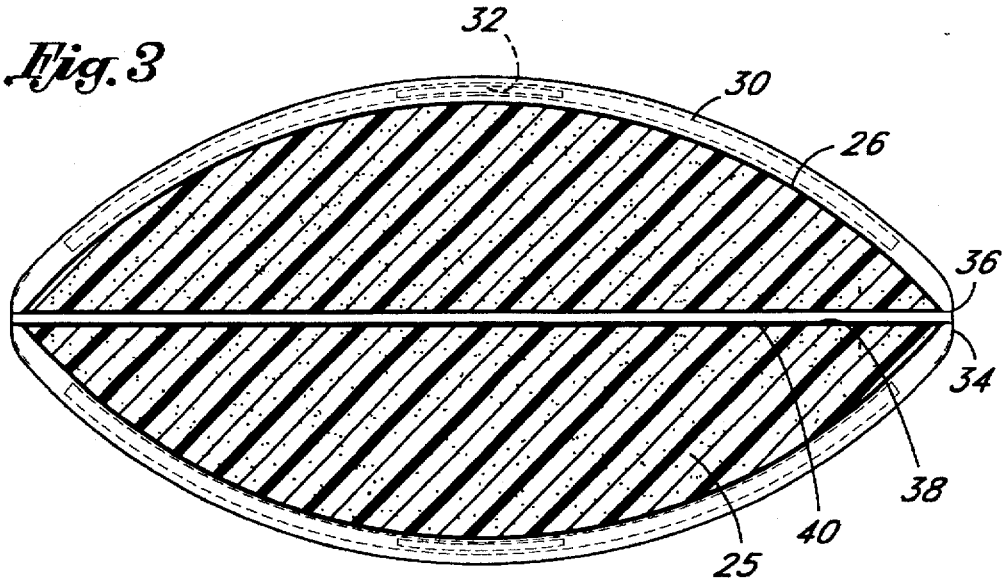
FIG. 3 is a cross-sectional view through the illuminated sports ball taken along line 3—3 of FIG. 1.

To more securely fasten the flexible housing 28 to the football 20, however, a central throughbore 38, best seen in FIG. 3, is formed through the centerline of the football from nose-to-nose 24. An anchor cord 40 extends entirely through the throughbore 38 and couples with the junctions 36 at opposite ends of the bore. The anchor cord 40 is preferably heat bonded to the junctions 36 and serves to securely maintain the position of the junctions 36 at the football noses 24. In this manner, in case a portion of the flexible housing 28 toward the center of the body portion 22 becomes disengaged from the groove 26, the anchoring of the junctions 36 provided by the cord 40 tends to cause the flexible tubing to resiliently snap back into the groove. The anchor cord 40 may be constructed of a variety of materials, but it is presently contemplated that the cord 40 be made of a similar material as the flexible housing 28, although the cord is preferably a solid cross-sectional member.

Alternatively, the anchor cord 40 may be an extension of the flexible housing 28 of one or both of the outer flexible tubes. Moreover, the entire length of outer flexible housing 28 and inner anchor cord 40 may be made of an integral piece of tube. To accomplish this, the first end of the tube terminates at one of the junctions 36 and extends around one of the grooves 26 and into the throughbore 38. The tube then exits axially through to the opposite end of the throughbore 38 and extends around the opposite groove 26 to terminate at the second junction 36. The junctions 36 are then heat bonded together.

It will be appreciated by those of skill in the art that a variety of configurations for anchoring the junctions 36 to the noses 24 of the football are possible. In the presently illustrated embodiment, the secured anchoring of the junctions 36 is provided without the use of any rigid fastening means. Thus, the compressibility of the football 20 is only minimally affected, and there is no increase of the risk of injury from being hit by a rigid portion of the football.

With reference to FIG. 5, the details of the flexible housing 28 are shown. The groove 26 is sized approximately one half the diameter of the flexible housing 28 so that a semicircular cross-section of the flexible tubing extends outward from the exterior of the body 22. In one specific embodiment constructed in accordance with this invention, the diameter of the flexible housing 28 equals 1.0 centimeter, and the groove 26 has a depth of approximately 0.5 centimeter. Thus, the groove 26 has an approximately semicircular cross-section and about one-half of the flexible housing 28 projects outward from the exterior surface of the ball 20.

The tubular housing 44 encloses the chemiluminescent liquid 46 therein. An inner wall 42 of the flexible housing 28 is sized slightly larger than the tubular light source 30. More particularly, the tubular light source 30 comprises a tubular housing 44 having an outer diameter of approximately 0.5 centimeters. The diameter of the inner wall 42 may be between 0.5 and 0.8 centimeters. To facilitate insertion and removal of the light source 30 from the flexible housing 28, a tubular space 48 is provided between the outer wall of the tubular housing 44 and the inner wall 42 of the tubing. The light source 30 can easily slide within the flexible tubing, but is restricted somewhat toward the terminal ends of the flexible tubing by the decreased diameter toward the crimped region 34 proximate the junction 36.

In another advantageous feature of the invention, the insertion slot 32 is located around the circumference of the flexible tubing to face the groove 26 in a relaxed position of the tubing. More particularly, and as seen in FIG. 5, the slot 32 is located around the circumference of the flexible housing 28 to be hidden in normal use of the football 20. Because of the flexible nature of the foam 25, the football 22 can be compressed around the groove 26 and/or the housing 28 stretched outward slightly to separate the tubing from the groove. The flexible housing 28, which possesses torsional flexibility, can then be rotated to expose the slot 32 for insertion and removal of the light source 30. Upon release of the flexible housing 28, the tubing naturally retracts back into the groove and rotates so that the slot 32 is hidden once again. This configuration protects the edges of the slot 32, and the light source 30 therewithin, and also helps prevent introduction of dirt and debris into the interior of the flexible housing 28.

Figure 6:
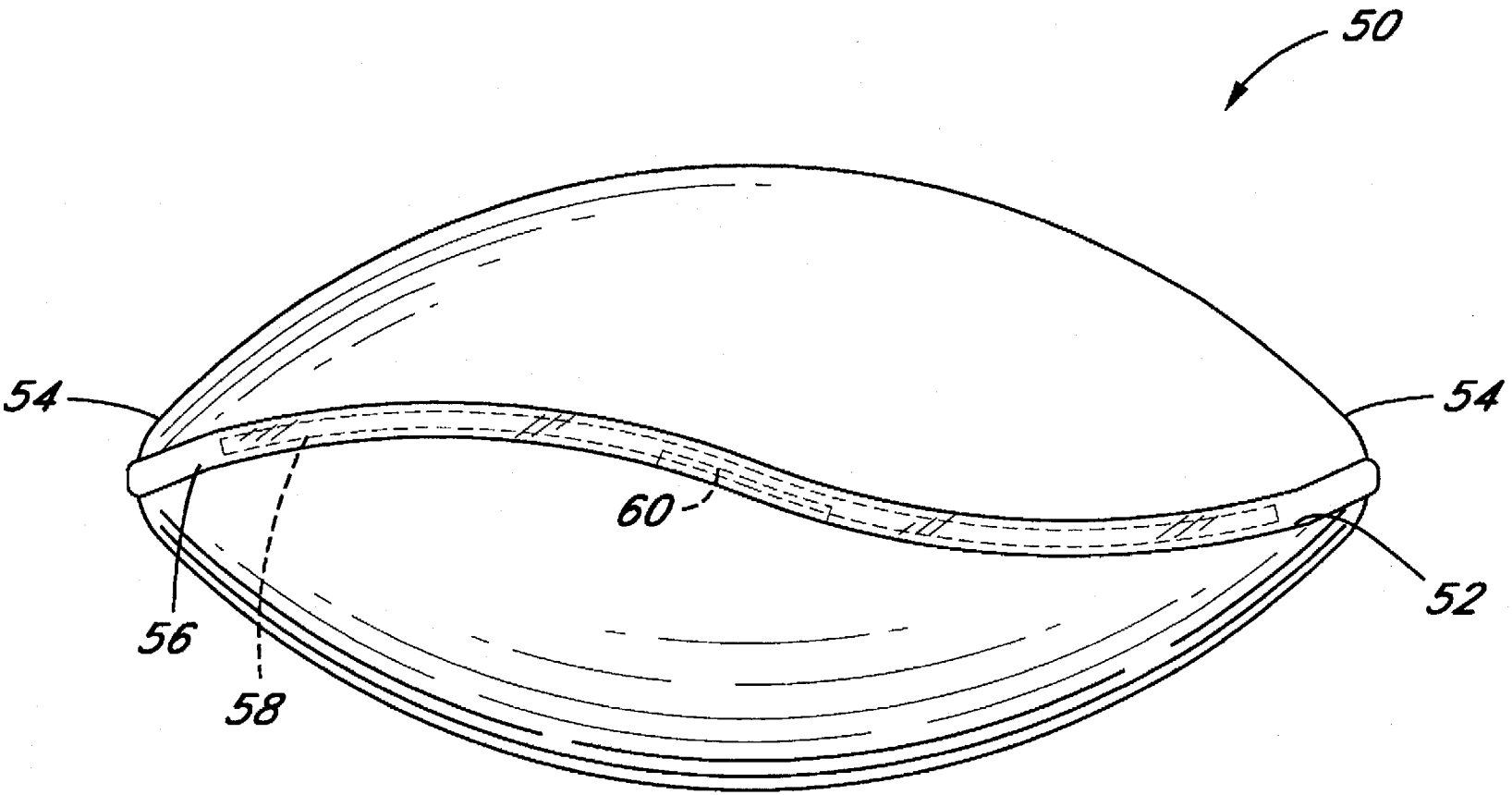
FIG. 6 is a side elevational view of an alternative embodiment of the illuminated sports ball.

In an alternative embodiment shown in FIG. 6, a football 50 includes a groove 52 extending from one nose 54 to another in a nonlinear or curvilinear path. The flexible tubing 56 and light source 58 therewithin thus traverse the nonlinear path on the exterior of the ball 50. In this embodiment, the nonlinear path comprises a shallow S shape from one nose 54 to the other. The football 50 also includes the central anchor cord (not shown) to maintain the terminal ends of the flexible tubing 56 proximate the noses 54. Because of the shallow curvature of the path, the flexible tubing is not secured as tightly along the football 50 as in the first embodiment, but the provision of the groove 52 helps maintain the flexible tubing in place. In this embodiment, the groove 52 may be made slightly deeper than the groove 26 in the first embodiment, so that the flexible tubing 56 is retained more securely therewithin.

Figure 8:
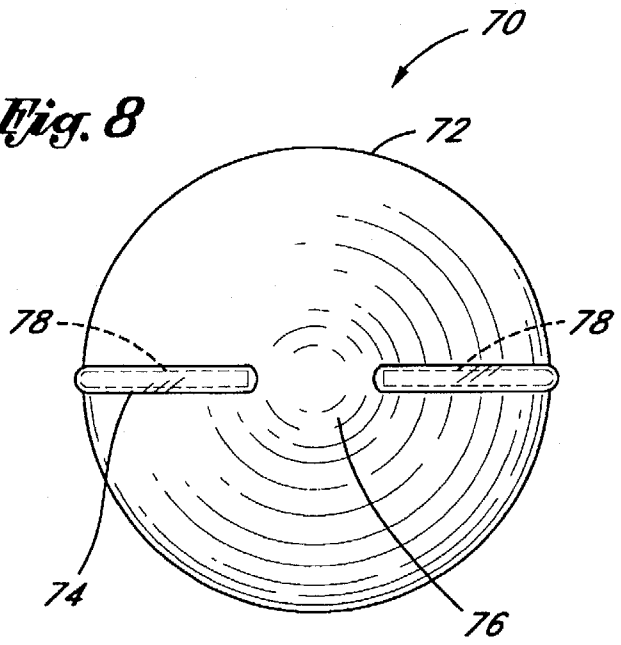
FIG. 8 is an end elevational view of the sports ball shown in FIG. 7.
Figure 7:
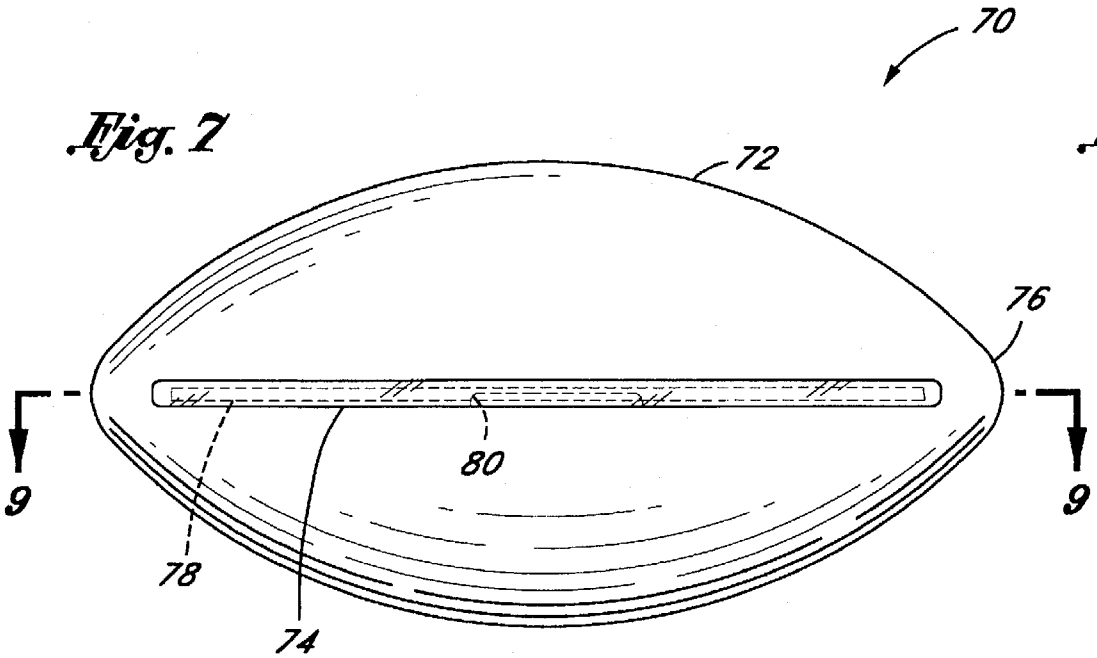
FIG. 7 is a side elevational view of an alternative embodiment of the illuminated sports ball of the present invention.

An alternative sports ball 70 is shown in FIGS. 7 and 8 includes shortened grooves on its exterior surface 72 and light-source retaining elements 74 modified accordingly to lie in the grooves. As in the earlier described embodiment, the sports ball comprises a football having a generally lenticular body terminating at opposite noses 76. The light-source retaining elements 74 desirably comprise transparent or nearly transparent flexible tubing and encapsulate elongated light sources 78 therewithin. The elements 74 each include a longitudinally-oriented slot 80 located centrally between the opposed noses 76 with a length sufficient to allow insertion and removal of the light source 78. FIG. 8 illustrates the alternative sports ball from an end and shows the termination of the grooves and exposed portions of modified tubular elements 74 short of the noses 76 of the ball 70.

Figure 9A:
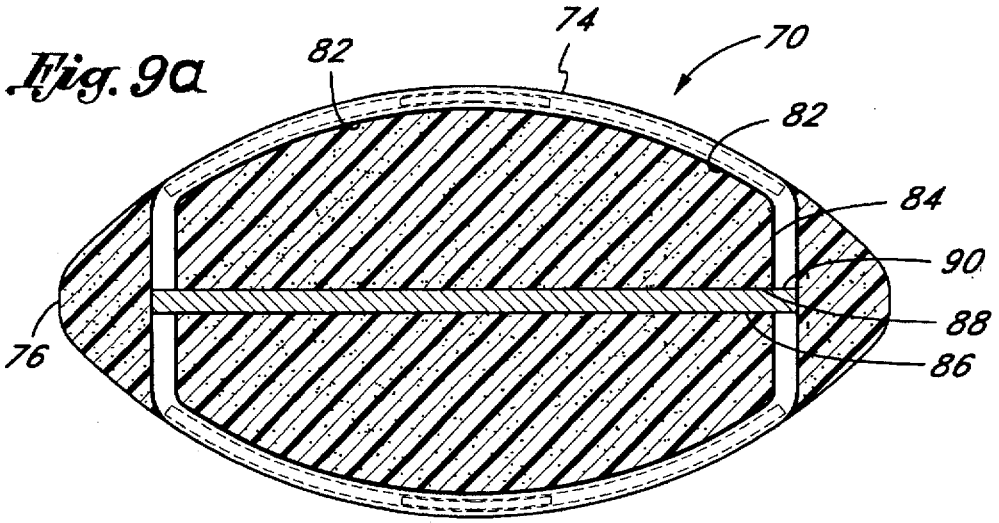
FIG. 9*a* is a cross-sectional view of one possible cross-section of the alternative sports ball, taken along line 9—9 of FIG. 7.

FIG. 9*a* illustrates, in cross-section, a first embodiment of the alternative sports ball 70 having the modified tubular elements 74 extending from modified grooves 82 through short channels 84 to join at an anchor cord 86 provided along an axial bore 88. The channels 84 extend perpendicular to the axis of the ball 70. The ends of the tubular elements 74 are joined (preferably welded) to the anchor cord 86 at junctions 90. In this modified arrangement the axial bore 88 does not extend to the exterior surface of the ball, thus reducing wear at the noses 76 which often impact the ground first.

Figure 9B:
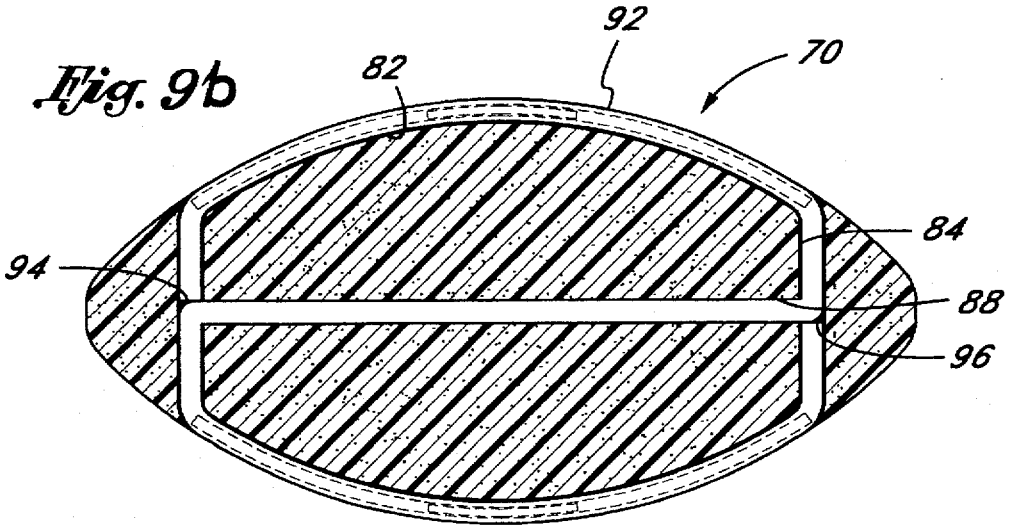
FIG. 9*b* is a cross-sectional view of a second possible cross-section of the alternative sports ball of FIG. 7.

FIG. 9*b* illustrates, in cross-section, a second embodiment of the alternative sports ball 70, having the shortened axial bore 88 and perpendicular channels 84. Instead of a separate anchor cord through the bore 88, a modified tubular element 92 adapted to retain the source of illumination on the exterior of the ball provides the entire anchoring structure. The elongated tubular element 92 extends from a junction 94 outward through one of the short channels 84 and along an upper groove 82 around the exterior of the ball (from left to right as seen in FIG. 9*b*). The element 92 reenters the ball at a second channel 84, turns 90° to the left to traverse a majority of the length of the ball along the axial bore 88, and exits the interior of the ball from a third channel. The element 92 continues along the lower groove 82 and enters the ball again through a fourth channel 84 to join with itself at a junction 96. The attachment joints at the junctions 94 and 96 are preferably welds, but may also be adhesive bonds or other suitable joint. In this embodiment, a separate anchor cord through the center of the ball 70 is eliminated.

Figure 9C:
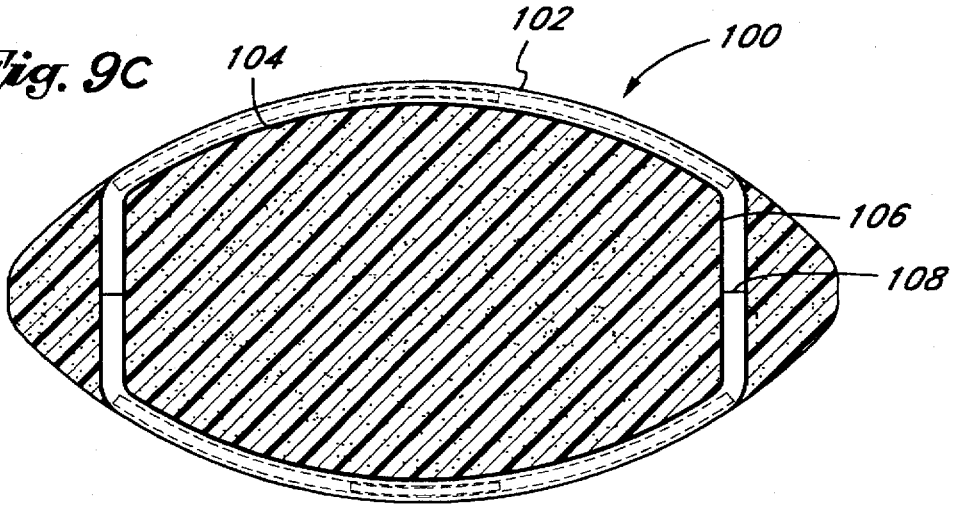
FIG. 9c is a cross-sectional view of a third possible cross-section of the alternative sports ball of FIG. 7.

FIG. 9*c* shows, in cross-section, an alternative embodiment 100 of the illuminated sports ball which is similar to the sports ball 70, but without the shortened axial bore 88. In this embodiment, two tubular elements 102 extend along modified grooves 104 and enter the interior of the ball 100 from the grooves at channels 106 disposed substantially perpendicularly to the central axis of the ball. The channels 106 each preferably extend in a straight line from a groove 104 on one side of the ball 100 to another groove. The tubes 102 are joined within the ball 100 in the channels 106 at junctions 108. Alternatively, a single length of flexible tube 102 can be provided with only one of the junctions 108 needed within the ball.

Figure 10:
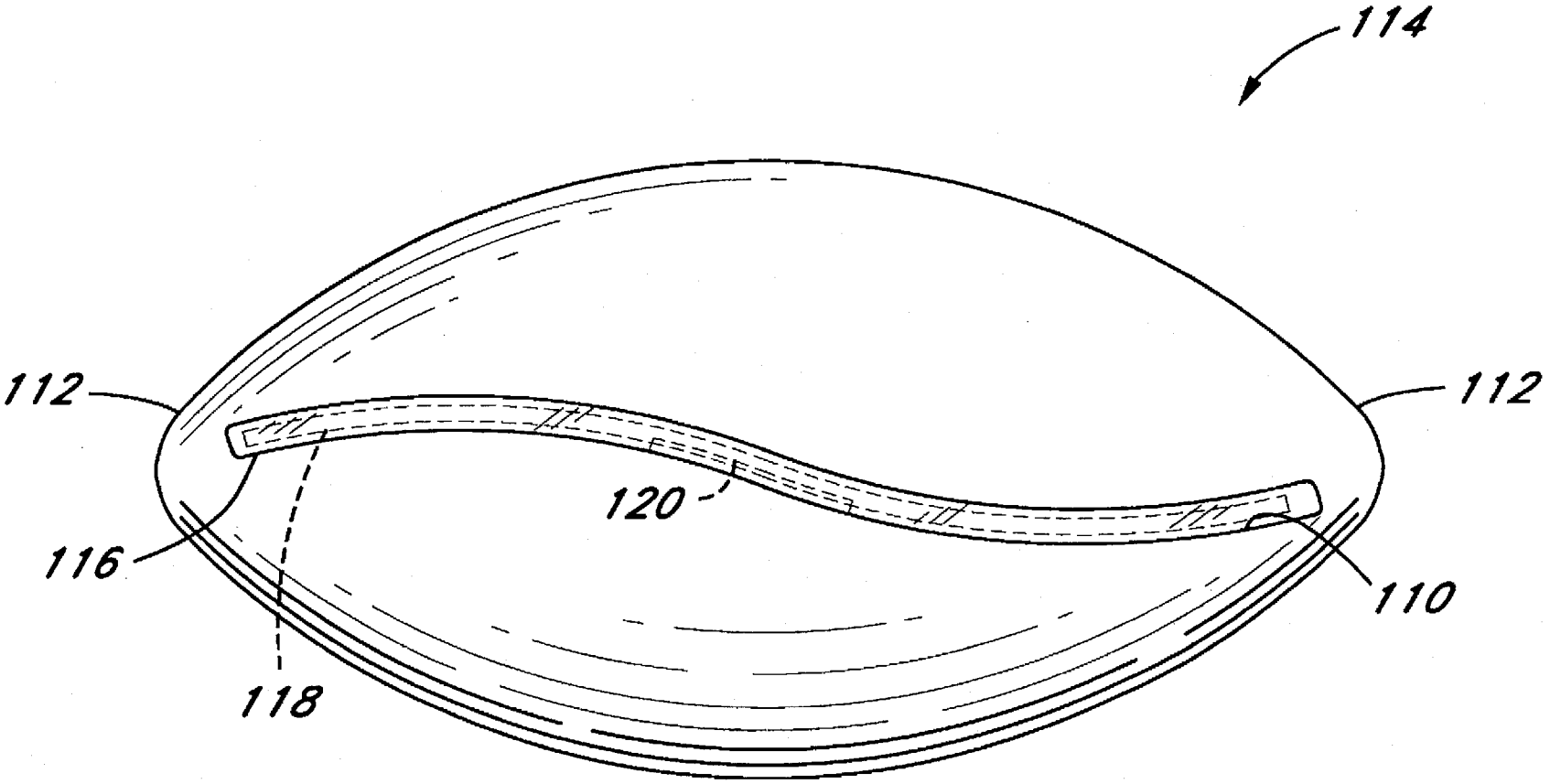
FIG. 10 is a side elevational view of a still further embodiment of the illuminated sports ball, similar to that shown in FIG. 7 but having a curvilinear groove in an exterior surface.

FIG. 10 illustrates another embodiment of the invention in which an illuminated sports ball 114 has a curvilinear groove 110 similar to the groove 52 shown in FIG. 6. Groove 110 terminates short of the noses 112 of the sports ball 114. A modified transparent or substantially transparent tubular housing 116 is secured within groove 110. For example, the opposite ends of this housing 116 may enter the interior of the ball 114 at the terminal ends of each modified groove 110. A flexible light source 118 may be inserted into a slot 120 in the housing 116 for illuminating the ball 114.

Although this invention has been described in terms of certain preferred embodiments, other embodiments that will be apparent to those of ordinary skill in the art are intended to be within the scope of this invention. Accordingly, the scope of the invention is intended to be defined by the claims that follow.

What is claimed is:

1. An illuminated foam sports ball which is easily and quickly illuminated without the use of batteries or electric lamps and wherein the illuminating means does not substantially offset the aerodynamics, feel, or balance of the ball, comprising:

a body having an exterior surface and at least two grooves extending around said body between points on said exterior surface;

two elongated flexible hollow transparent tubular housings each sized to receive a flexible chemiluminescent light stick and sized to fit within said grooves and extend between said points, said tubular housings each having an external diameter sized approximately the same as the diameter of said grooves and said grooves each having an approximately semi-circular cross-section, so that about one-hair of said tubular housing projects outward from said exterior surface;

a slot in each housing for easily inserting and removing said light sticks while securely retaining the light sticks in the housings;

a bore extending through said ball; and an anchor cord within said bore attached to both ends of said tubular housings to help retain said tubular housings within said grooves.

2. The ball of claim 1, wherein said housings have torsional flexibility and said slots are positioned around the circumference of said tubular housings so as to face said grooves in a relaxed orientation of said tubular housings, said slots being accessible to the exterior of said ball by twisting said housings about their axes.

3. The ball of claim 1, wherein said ball is a football having two points common to both grooves and located at opposite noses of said football, and wherein said grooves are both located substantially within a common axial of said ball.

4. The ball of claim 1, wherein said ball is a football and wherein said grooves extend in curvilinear paths between said points.

5. A sports ball which is easily and quickly illuminated without the use of batteries or electric lamps and wherein the illuminating means does not substantially offset the aerodynamics, feel, or balance of the ball, comprising:

a compressible body having an exterior surface and at least one groove extending around said body between two points on said exterior surface;

an elongated flexible hollow tubular substantially transparent housing element adapted to receive a light-emitting source and sized to fit within said groove and extend between said two points, wherein said housing element comprises a transparent housing sized to receive a flexible chemiluminescent light stick.

6. The ball of claim 5, further comprising two grooves formed in said exterior surface each sized to receive one of said housing elements, said housing elements connected together at two junctions to help retain said housing elements in said grooves.

7. The ball of claim 6, wherein said ball is a football and said two points are common to both grooves and are located at opposite noses of said football.

8. The bail of claim 6, wherein said ball is a football and said grooves are both located substantially within a common axial plane of said ball.

9. The ball of claim 5, wherein each housing includes a slot for insertion and removal of said light sticks.

10. The ball of claim 9, wherein the length of each tubular housing and the length of the slot within the housing are such that the distance from one end of said housing to a distal end of said slot is sufficient to facilitate insertion of said light stick through said slot into said housing.

11. The ball of claim 10, wherein said slot is centered in said tubular housing between said two points.

12. The ball of claim 9, wherein said housings have torsional flexibility and said slot is positioned around the circumference of said housing element so as to face said groove in a relaxed orientation of said housing element, said slot being accessible to the exterior of said ball by twisting said housing.

13. The ball of claim 5, wherein said body is a foam-type material.

14. The ball of claim 13, further including:

a bore extending through said ball; and an anchor cord within said bore attached to both ends of said housing element to help retain said housing element within said groove.

15. The ball of claim 14, wherein said anchor cord comprises a length of said housing.

16. The ball of claim 14, further comprising two grooves formed in said exterior surface each sized to receive one of said housing elements, said housing elements both connected to said anchor cord to help retain said housing elements in said grooves.

17. The ball of claim 16, wherein said grooves meet at two points located at the intersection of said bore and said exterior surface, said housing elements being connected to said anchor cord at said two points.

18. The ball of claim 14, further comprising two grooves formed in said exterior surface each sized to receive one of said housing elements, wherein each of said grooves terminates at points on said exterior surface and said ball further comprises channels connecting said points with said bore, said housing elements extending within the channels into the interior of the ball and being connected to said anchor cord at the intersection of said bore and said channels.

19. The ball of claim 14, wherein said bore extends through the center of the ball.

20. The ball of claim 19, wherein said ball is a football and wherein said bore is located along the axis of said ball between opposite noses of the football.

21. The ball of claim 5, wherein said housing elements have an external diameter sized approximately the same as the diameter of said groove and said groove having an approximately semi-circular cross-section, so that about one-half of said housing element projects outward from said exterior surface.

22. An illuminated sports ball, comprising:

a compressible body having an exterior a bore formed in the interior of said ball and at least one exterior groove formed between points on said exterior surface;

an elongated flexible hollow tubular element adapted to receive a light-emitting source and sized to fit within said groove and extend between said points around said sports ball; and an anchor cord positioned with said throughbore and attached to opposite ends of said element to help retain said element in said groove around said sports ball.

23. The sports ball of claim 22, further including:

at least two grooves formed on said exterior surface and two elements, one positioned in each groove, said anchor cord being attached to opposite ends of both elements, said elements each having an external diameter sized approximately the same as the diameter of said grooves and said grooves having an approximately semi-circular cross-section, so that about one-half of said elements project outward from said exterior surface.

24. The sports ball of claim 23, wherein each of said grooves lies within an axial plane of said sports ball.

25. The sports ball of claim 22, wherein said element comprises a transparent housing sized to receive a flexible chemiluminescent light stick.

26. The sports ball of claim 25, wherein said anchor cord comprises a length of said housing. ball and securing them to a separate anchoring member provided in said ball.

27. A method of manufacturing an illuminated foam sports ball without substantially affecting the aerodynamics, feel or balance of the ball, comprising the steps of:

forming the body of said ball with an exterior surface in which a groove extends between points on said exterior surface;

positioning two elongated flexible tubular substantially transparent housing elements in said grooves, said elements adapted to receive light-emitting sources; and retaining said elements within said grooves wherein said step of retaining comprises extending said flexible housing elements from said grooves into the interior of said ball and securing them to a separate anchoring member provided in said ball.

28. The method of claim 27, further including the steps of forming a bore in the interior of said ball along a centerline thereof and positioning said anchoring member in said bore.

29. A method of manufacturing an illuminated foam sports ball, comprising the steps of:

forming a body of said ball with an exterior surface;

forming a pair of grooves on said exterior surface, each extending on opposite sides of said ball between points on said exterior surface;

forming a bore in the interior of said ball;

positioning two elongated flexible tubular elements in said grooves, said elements adapted to receive light-emitting sources;

positioning an anchor cord within said bore; and joining said two elements to said anchor cord to help retain said elements within said grooves.

30. A method of manufacturing an illuminated foam sports ball without substantially affecting the aerodynamics, feel or balance of the ball, comprising the steps of:

forming the body of said ball with an exterior surface in which a groove extends between points on said exterior surface;

positioning two elongated flexible tubular substantially transparent housing elements in said grooves, said elements adapted to receive light-emitting sources; and retaining said elements within said grooves, wherein said step of retaining comprises extending said flexible housing elements from said grooves into the interior of said ball and securing them to each other.

* * * * *